US007853382B2

(12) United States Patent
Anderson

(10) Patent No.: US 7,853,382 B2
(45) Date of Patent: Dec. 14, 2010

(54) LOADER BOOM CONTROL SYSTEM

(75) Inventor: Eric R Anderson, Galena, IL (US)

(73) Assignee: Deere & Company, Moline, IL (US)

( * ) Notice: Subject to any disclaimer, the term of this patent is extended or adjusted under 35 U.S.C. 154(b) by 1040 days.

(21) Appl. No.: 11/536,892

(22) Filed: Sep. 29, 2006

(65) Prior Publication Data

US 2008/0082239 A1 Apr. 3, 2008

(51) Int. Cl.
*G06F 19/00* (2006.01)
*G08B 21/00* (2006.01)

(52) U.S. Cl. ..... 701/50; 37/348; 37/91; 414/699; 56/10.2 R; 56/10.2 G; 340/684

(58) Field of Classification Search ..... 701/50; 37/348, 91; 711/100; 73/492; 414/699, 414/694; 56/10.2 R, 10.2 G; 340/686, 685, 340/684, 679, 500
See application file for complete search history.

(56) References Cited

U.S. PATENT DOCUMENTS

| | | | | |
|---|---|---|---|---|
| 5,564,507 | A | 10/1996 | Matsushita et al. | |
| 5,730,678 | A | 3/1998 | Larkin | |
| 5,748,097 | A * | 5/1998 | Collins | 340/686.1 |
| 5,868,640 | A | 2/1999 | Coutant | |
| 5,983,151 | A | 11/1999 | Okada et al. | |
| 6,203,463 | B1 | 3/2001 | Casey et al. | |
| 6,205,385 | B1 | 3/2001 | Stelzle et al. | |
| 6,309,323 | B1 | 10/2001 | Steeby | |
| 6,371,882 | B1 | 4/2002 | Casey et al. | |
| RE37,703 | E | 5/2002 | Bellinger | |
| 6,427,107 | B1 | 7/2002 | Chiu et al. | |
| 6,440,038 | B1 | 8/2002 | Holloway | |
| 6,609,056 | B1 | 8/2003 | Czarnecki et al. | |
| 6,636,795 | B1 | 10/2003 | Morscheck | |
| 6,663,535 | B2 | 12/2003 | Holloway | |
| 6,735,889 | B1 * | 5/2004 | Berger et al. | 37/348 |
| 6,745,117 | B1 | 6/2004 | Thacher et al. | |
| 6,807,474 | B2 | 10/2004 | Bergqvist et al. | |
| 6,904,993 | B1 | 6/2005 | Rinck | |

(Continued)

OTHER PUBLICATIONS

Non-Final Office Action dated Oct. 2, 2009 for U.S. Appl. No. 11/446,626, filed Jun. 5, 2006; First Named Inventor, Jahmy Hindman.

(Continued)

*Primary Examiner*—Ronnie Mancho
(74) *Attorney, Agent, or Firm*—Baker & Daniels LLP

(57) ABSTRACT

A work vehicle that includes a boom; a boom actuator connected to the boom, the boom actuator being adapted to controllably move the boom about a boom pivot in response to receiving a boom control signal; and a controller having computational and time-keeping capabilities. The controller communicates with the boom actuator, and calculates the boom velocity, compares the calculated velocity to a commanded velocity to obtain a velocity error, and, if necessary, de-rates the tractive effort of the wheels to prevent the boom from stalling. The controller also determines if the operator is actuating the boom, and reads the boom position to calculate the boom velocity based upon the current boom position and a previous boom position. The controller uses a predefined algorithm to de-rate the tractive effort of the wheels as a function of the power train configuration.

25 Claims, 4 Drawing Sheets

U.S. PATENT DOCUMENTS

| | | | |
|---|---|---|---|
| 6,957,139 | B2 | 10/2005 | Bellinger |
| 6,963,796 | B2 | 11/2005 | Larson et al. |
| 7,222,014 | B2 | 5/2007 | Tao et al. |
| 7,399,255 | B1 | 7/2008 | Johnson et al. |
| 7,555,855 | B2 | 7/2009 | Alshaer et al. |
| 2004/0143383 | A1 | 7/2004 | Kuepper et al. |
| 2005/0075773 | A1 | 4/2005 | Schweizer et al. |
| 2005/0102082 | A1 | 5/2005 | Joe et al. |
| 2006/0105883 | A1 | 5/2006 | Krisher et al. |
| 2006/0234829 | A1 | 10/2006 | Berger et al. |
| 2007/0281826 | A1 | 12/2007 | Hindman et al. |
| 2008/0034853 | A1 * | 2/2008 | Tabor et al. ..... 73/118.1 |

OTHER PUBLICATIONS

Amendment to Non-Final Office Action filed Jan. 4, 2010 for U.S. Appl. No. 11/446,626, filed Jun. 5, 2006; First Named Inventor, Jahmy Hindman.

Final Office Action dated Apr. 14, 2010 for U.S. Appl. No. 11/446,626, filed Jun. 5, 2006; First Named Inventor, Jahmy Hindman.

Amendment to Final Office Action filed Jul. 14, 2010 for U.S. Appl. No. 11/446,626, filed Jun. 5, 2006; First Named Inventor, Jahmy Hindman.

* cited by examiner

LOADER BOOM CONTROL SYSTEM

BACKGROUND OF THE INVENTION

The present invention relates generally to a control for a loader boom, and in particular, to a loader boom control designed to maintain consistent boom performance regardless of the operator to avoid boom stall problems.

Numerous types of machines are available that can be equipped with one or more tools to perform a work function. One type of such a work machine is commonly called a wheel loader and may be used to load material from a pile. One problem with loaders, though, is that some operators tend to be more adept at maneuvering the boom into and picking up a load of material. A skilled operator uses an appropriate boom velocity and traction force/rimpull to enable the bucket to smoothly pick up as much material as possible. If an operator is not skilled in maneuvering the boom to the pile, it may directly affect the loader's performance. The operator may cause the bucket on the boom to become stuck or stalled in the material, requiring additional time and manipulation to free it.

In other words, the velocity in which the boom is directed to the pile and the traction force employed have a direct impact on the efficiency of digging material from the pile. Trapping of the boom can happen in different conditions when the combined effects of the material and the machine's own tractive effort exceed the forces required to break the boom free from the pile.

It is, therefore, an object of the subject invention to provide a loader having a boom with a control to maintain consistent performance of the loading operation regardless of the operator. Such a system would enable a less skilled operator to close the gap with a skilled operator without requiring the same level of experience or training. It is a further object of the invention to reduce or eliminate stalling or trapping of the boom based upon operator inexperience and failure to achieve optimal boom velocity. A further object of the invention is to calculate and compare the boom velocity to an optimal velocity in order to improve the efficiency and help prevent trapping of the boom. An additional object of the invention is to provide a control system for the boom of a loader that actively monitors its boom performance and adjusts the power train to maintain the same boom performance regardless of the operator. An additional object of the invention is to provide operator adjustment to allow the operator to adjust the setting for different operating conditions. These and other objects, features, and advantages of the present invention will become apparent to those skilled in the art from the descriptions and drawings which follow.

SUMMARY OF THE INVENTION

In one embodiment of the invention, a work vehicle is provided that includes a frame; an engine mounted to the frame; a plurality of wheels connected to the frame that are rotatable relative to the frame, with at least one of the wheels being driven by the engine; a boom having a first end and a second end, the first end being pivotally attached to the frame about a boom pivot; a tool pivotally attached to the second end of the boom about a tool pivot, the tool being adapted to perform a work function; a boom actuator connected to the boom, the boom actuator being adapted to controllably move the boom about the boom pivot in response to receiving a boom control signal; and a controller having computational and time-keeping capabilities. The controller is in communication with the boom actuator, and adapted to calculate the boom velocity, to compare the calculated velocity to a commanded velocity to obtain a velocity error, and to de-rate the tractive effort of the wheels, if necessary.

The controller is adapted to determine if the operator is actuating the boom, and to read the boom position. The controller can calculate the boom velocity based upon the current boom position and a previous boom position.

The controller may use a predefined algorithm to de-rate the tractive effort of the wheels. The controller may also control the boom actuator to adjust the boom velocity to eliminate the velocity error. The tractive effort of the wheels can be de-rated as a function of the power train configuration, which may include a torque converter, and the tractive effort may be reduced by reducing the engine speed.

In another feature of the invention, a method for controlling a boom of a work vehicle is disclosed that includes the steps of providing a work vehicle having a frame, an engine mounted to the frame, a plurality of wheels with at least one of the wheels being driven by the engine, a boom having a first end pivotally attached to the frame about a boom pivot, a boom actuator being adapted to controllably move the boom about the pivot in response to receiving a boom control signal, and a controller having computational and timekeeping capabilities and being in communication with the boom actuator; determining if the operator is actuating the boom and reading the boom position; calculating the boom velocity; and comparing the calculated velocity to a commanded velocity to obtain a velocity error.

The work vehicle may further include a position sensor connected to the boom actuator, and the boom velocity may be calculated by the controller based upon a current boom position and a previous boom position as sensed by the position sensor.

The method may also include the steps of de-rating the tractive effort of the wheels using a predefined algorithm, and feeding the boom position into the algorithm for calculating the derivative and smoothing the signal.

The work vehicle may include a torque converter, and the method may further include the step of estimating the current tractive effort based upon engine speed and the torque converter's output speed. The method may also include the step of estimating commanded velocity of the boom based upon the speed of the engine and a boom command generated by the operator actuating the boom.

In another embodiment of the invention, a boom control system for a work vehicle is provided that includes a boom actuator connected to the boom, the boom actuator being adapted to controllably move the boom about a pivot in response to receiving a boom control signal; a position sensor connected to the boom actuator and capable of sensing the position of the boom; and a controller in communication with the boom actuator. The controller is adapted to determine if the operator is actuating the boom, to read the boom position, to calculate the boom velocity, and to compare the calculated velocity to a commanded velocity in order to obtain a velocity error.

The boom velocity may be calculated by the controller based upon a current boom position and a previous boom position as sensed by the position sensor. The controller can be adapted to de-rate the tractive effort of the wheels using a predefined algorithm that utilizes the boom position. The controller may estimate the current tractive effort of the wheels based upon engine speed and a torque converter's output speed. The controller may estimate the commanded velocity of the boom based upon engine speed and a boom command generated by an operator activating the boom actuator.

BRIEF DESCRIPTION OF THE DRAWINGS

The above-mentioned and other features and objects of this invention and the manner of obtaining them will become more apparent and the invention itself will be better understood by reference to the following description of embodiments of the present invention taken in conjunction with the accompanying drawings, wherein.

Figure 1:
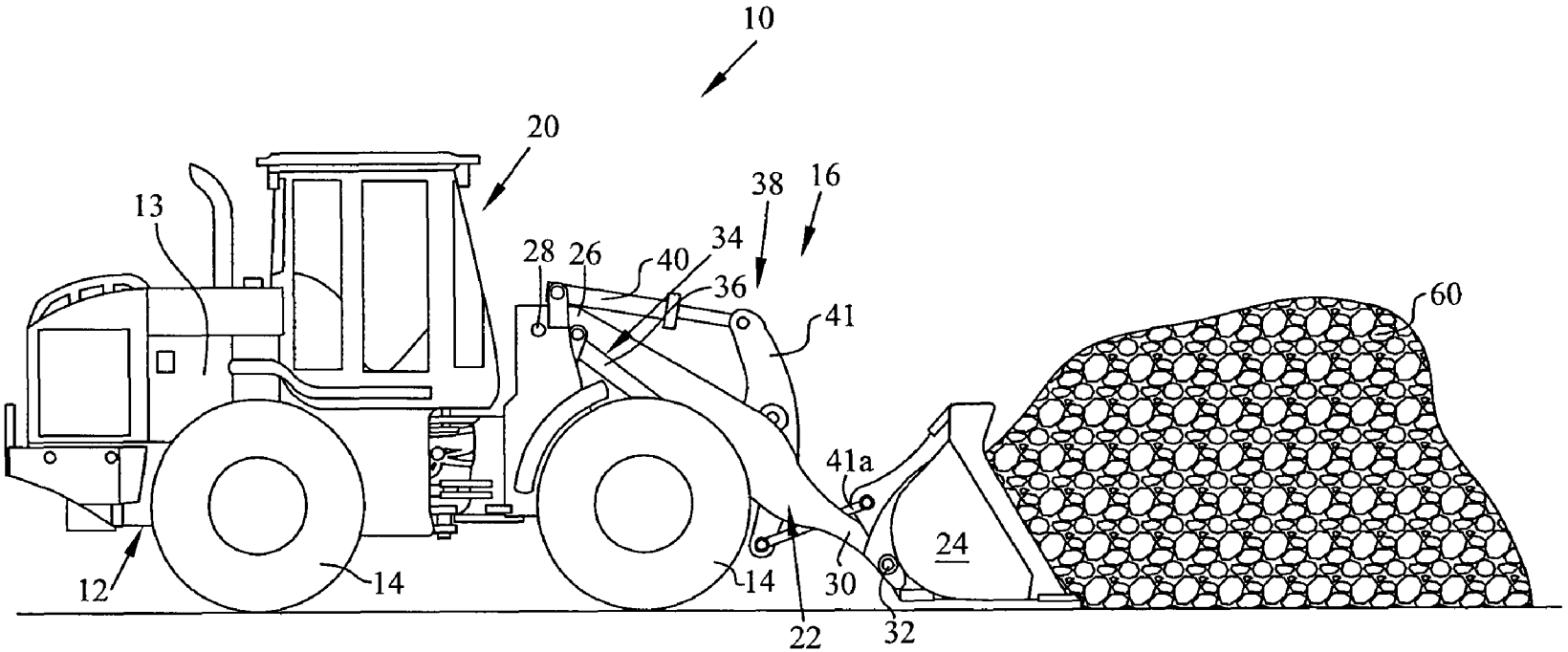
FIG 1 is a side view of a loader showing one embodiment of the invention with the boom and bucket initiating pickup of a load of material.

Corresponding reference characters indicate corresponding parts throughout the several views. Although the drawings represent embodiments of the present invention, the drawings are not necessarily to scale and certain features may be exaggerated in order to better illustrate and explain the present invention. The exemplification set out herein illustrates embodiments of the invention, and such exemplifications are not to be construed as limiting the scope of the invention in any manner.

DETAILED DESCRIPTION OF EMBODIMENTS OF THE INVENTION

For the purposes of promoting an understanding of the principles of the invention, reference will now be made to the embodiments illustrated in the drawings, which are described below. It will nevertheless be understood that no limitation of the scope of the invention is thereby intended. The invention includes any alterations and further modifications in the illustrated devices and described methods and further applications of the principles of the invention, which would normally occur to one skilled in the art to which the invention relates.

Figure 2:
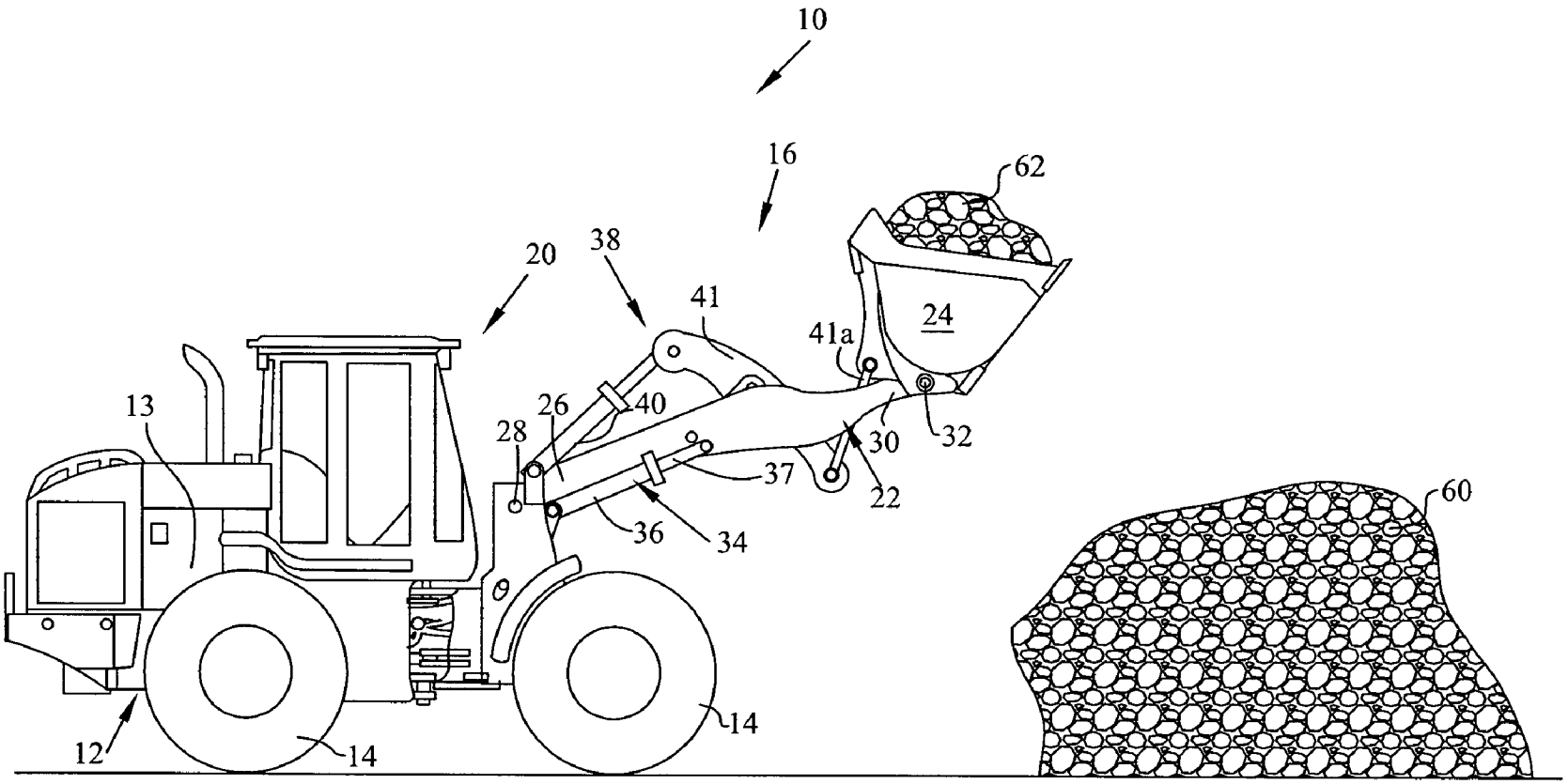
FIG 2 is a side view of the loader of FIG 1 with the boom raising a load of material.

Now referring to FIGS. 1 and 2, in one embodiment of the invention a self-propelled work vehicle is provided, such as a loader, and generally indicated as 10. Loader 10 includes a frame, generally indicated as 12, an engine 13, ground engaging wheels 14, which are attached to frame 12 in a manner that allows rotational movement relative thereto, as is known, and a loader assembly, generally indicated as 16. The loader assembly can perform a variety of excavating and material handling functions as known. An operator controls the functions of vehicle 10 from an operator station, generally indicated as 20.

Loader assembly 16 includes a loader boom, generally indicated as 22, and a tool 24, such as a loader bucket or other structure. Loader boom 22 has a first end 26 that is pivotally attached to frame 12 about a generally horizontal boom pivot 28, and a second end 30 to which loader bucket 24 is pivotally attached about a horizontal bucket pivot 32.

Loader assembly 16 also includes a loader boom actuator, generally indicated as 34, which in the embodiment shown, includes a hydraulic cylinder 36 having a piston rod 37. Hydraulic cylinder 36 extends between vehicle frame 12 and loader boom 22 and controllably moves the loader boom about loader boom pivot 28. Loader assembly 16 also includes a loader bucket actuator, generally indicated as 38, which in the embodiment shown, includes a loader bucket hydraulic cylinder 40. Hydraulic cylinder 40 extends between frame 12 and a bucket orientation control member 41, which together with a pivotally connected linking bar 41*a*, controllably move loader bucket 24 about loader bucket pivot 32.

Figure 3:
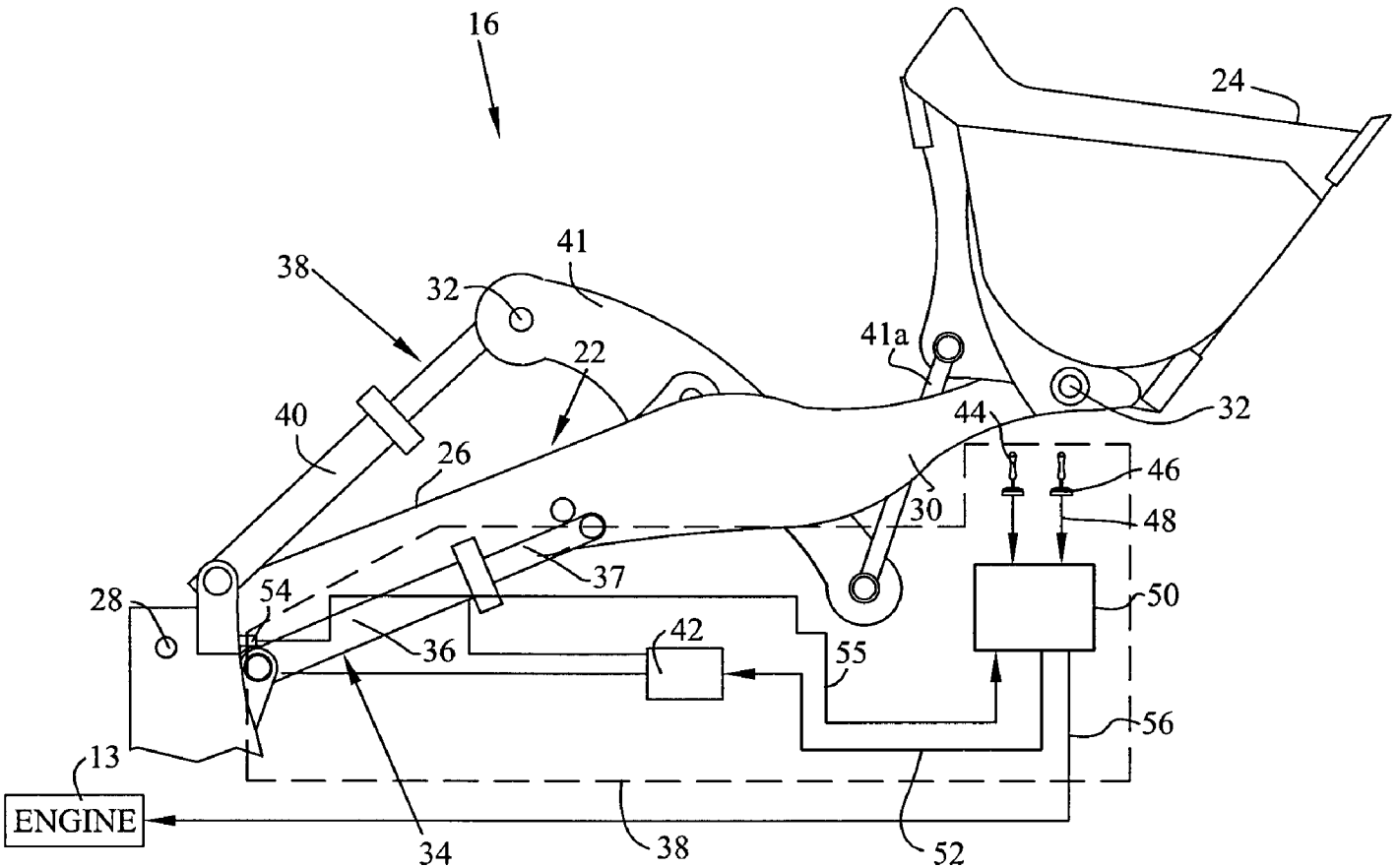
FIG 3 is a schematic diagram of a boom control system for the loader of FIG 1.

Now referring to FIG 3, loader assembly 16 also includes a boom electro-hydraulic circuit 42 that is hydraulically coupled to loader hydraulic cylinder 36. The boom electro-hydraulic circuit 42 supplies and controls the flow of hydraulic fluid to hydraulic cylinder 36.

An operator commands movement of loader assembly 16 by manipulating a loader bucket command input device 44 and a loader boom command input device 46. The loader boom command input device 46 is adapted to generate a loader boom command signal 48 in response to manipulation by the operator that is proportional to a desired loader boom movement. A controller 50, in communication with loader boom command input device 46 and loader boom actuator 34, receives the loader boom command signal 48 and responds by generating a loader boom control signal 52. The loader boom control signal 52 is received by the loader boom electro-hydraulic circuit 42. The loader boom electro-hydraulic circuit 42 responds to the loader boom control signal 52 by directing hydraulic fluid to the loader boom hydraulic cylinder 36 to cause the hydraulic cylinder to move the loader boom accordingly.

Loader boom assembly 16 also includes a position sensor 54. In one embodiment, position sensor 54 may be attached beneath the boom and includes a lever arm that measures angular displacement of loader boom 22 about boom pivot 28. Sensor 54 is in communication with controller 50 and transmits the position of loader boom 22 to controller 50 with a position signal 55. Controller 50 is adapted to receive position signal 55 and uses an algorithm to define and send a control signal 56 to an Engine Control Unit (ECU) to de-rate the engine speed, as discussed in further detail below.

During the work operation of loader assembly 16, wherein bucket 24 on loader boom 22 is inserted into a pile of material 60 for removal of a load 62 (FIG 2) thereof, it is desirable to maintain an optimum boom performance to obtain a full load of material without stalling or trapping the boom, as discussed above. To maintain the optimum boom performance, as loader boom 22 is moved about boom pivot 28 during a lifting operation, the operator must try to maintain an appropriate boom velocity, which is affected by the tractive effort of wheels 14. Accordingly, if the operator displays a lack of attention or skill to obtain the optimum boom velocity and/or traps the boom, it slows the overall work efficiency and may increase operator fatigue.

Figure 4:
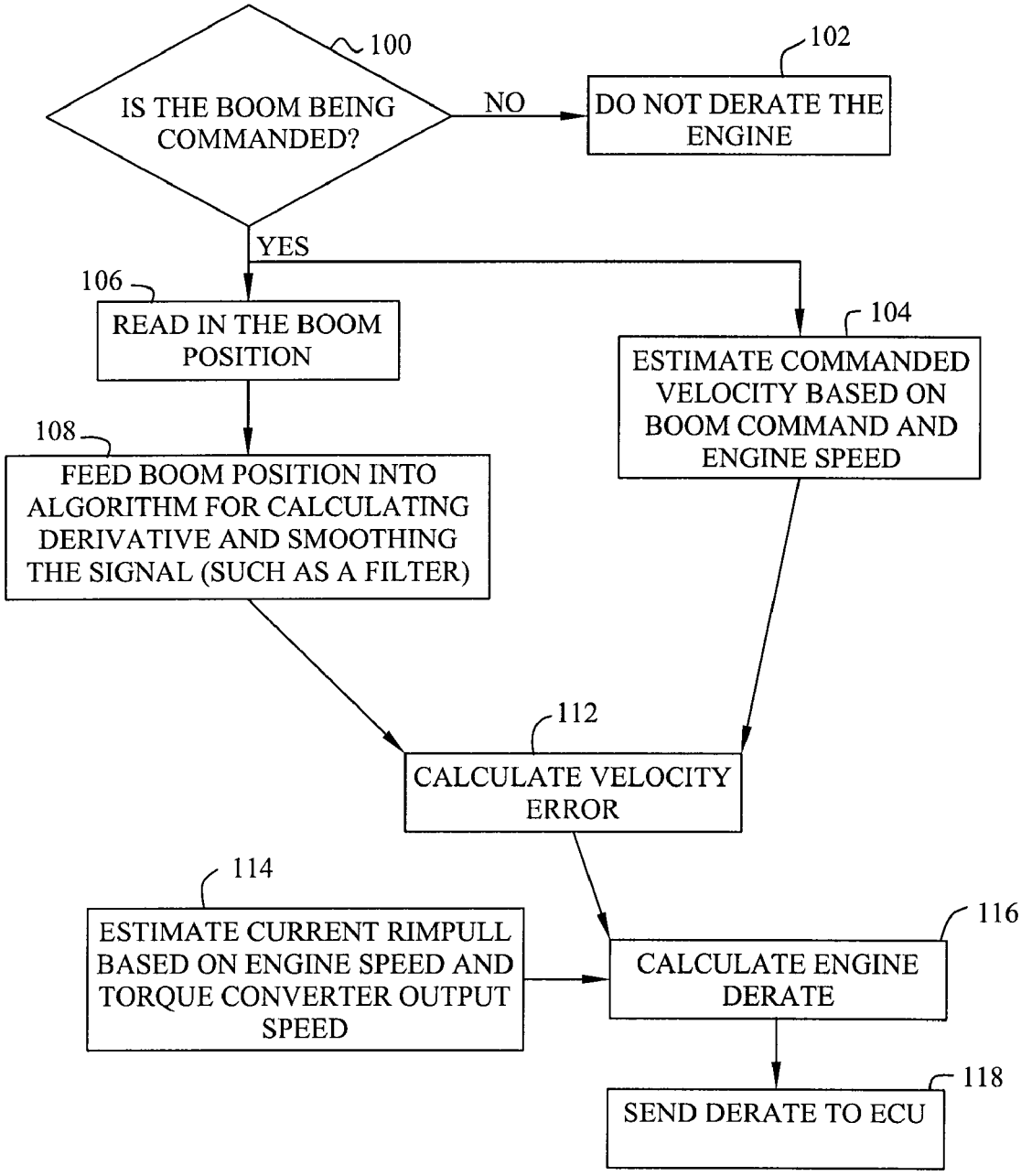
FIG 4 is a flow chart of the operation of the boom control system of FIG 4.

Now referring to FIG 4, the operation of the control system is detailed. In step 100, boom controller 50 determines if an operator is commanding the boom by activating loader boom input command device 46 and sending loader boom command signal 48. If the loader boom input command device 46 is not being actuated, then controller 50 will not de-rate the engine, as noted in step 102. On the other hand, if the boom is being commanded with boom command device 46, the controller will estimate the commanded velocity of the boom based upon the level of the loader boom command signal 48 and the engine speed (step 104). In addition, controller 50 will read the boom position from position signal 55 generated from position sensor 54 (step 106). The controller then feeds the boom position into an algorithm for calculating and smoothing the signal, which may be accomplished with a filter (step 108). A standard form predefined algorithm, such as P, PI, PID, or more advanced controls may be used. The actual boom velocity is compared to the commanded velocity, so that a velocity error is calculated (step 112). Based upon the velocity error and an estimated rimpull/tractive effort of the vehicle (which is based upon the engine speed and torque converter output speed) (step 114), control 50 calculates an engine de-rate to reduce the engine speed (step 116), if necessary. Then, as noted in step 118, controller 50 sends a de-rate signal to the engine control unit (ECU) to reduce the speed of the engine to eliminate the velocity error.

As the speed of the engine is reduced, the tractive effort/rimpull will also be reduced, which will result in an increase in the speed of the boom to prevent the boom from stalling in material 60 so that load 62 can be picked up without stalling. It should be appreciated that it is also contemplated to include an adjustment control to adjust the rimpull or engine speed at which de-rating may commence. This allows the operator to make adjustments based upon different operating conditions (i.e., the size and type of material being loaded, ground type/traction conditions, and amount of moisture in the material, etc.). As such, a work vehicle is provided that actively monitors its boom performance and adjusts the power train to maintain a consistent boom performance that is not dependent upon the operator's skill level or attentiveness.

While the invention has been taught with specific reference to these embodiments, one skilled in the art will recognize that changes can be made in form and detail without departing from the spirit and scope of the invention. The described embodiments are to be considered, therefore, in all respects only as illustrative and not restrictive. As such, the scope of the invention is indicated by the following claims rather than by the description.

The invention claimed is:

1. A work vehicle comprising:

a frame;

an engine mounted to the frame;

a plurality of wheels connected to the frame and being rotatable relative to the frame, and at least one of the wheels being driven by the engine;

a boom having a first end and a second end, the first end being pivotally attached to the frame about a boom pivot;

a tool pivotally attached to the second end of the boom about a tool pivot, the tool being adapted to perform a work function;

a boom actuator connected to the boom, the boom actuator being adapted to controllably move the boom about the boom pivot in response to receiving a boom control signal; and a controller in communication with the boom actuator, the controller being adapted to determine the boom velocity, to compare the boom velocity to a commanded velocity to obtain a velocity error, and to de-rate the tractive effort of the wheels in response to the velocity error.

2. The work vehicle as set forth in claim 1, the controller being further adapted to determine if the operator is actuating the boom.

3. The work vehicle as set forth in claim 2, wherein the controller is further adapted to read the boom position.

4. The work vehicle as set forth in claim 3, wherein the controller determines the boom velocity based upon the current boom position and a previous boom position.

5. The work vehicle as set forth in claim 1, wherein the controller uses a predefined algorithm to de-rate the tractive effort of the wheels.

6. The work vehicle as set forth in claim 1, wherein the controller controls the boom actuator to adjust the boom velocity to eliminate the velocity error.

7. The work vehicle as set forth in claim 1, wherein tractive effort of the wheels is de-rated as a function of the power train configuration.

8. The work vehicle as set forth in claim 7, further including a torque converter.

9. The work vehicle as set forth in claim 8, wherein the tractive effort is reduced by reducing the engine speed.

10. A method for controlling a boom of a work vehicle comprising the steps of:

providing a work vehicle having a frame, an engine mounted to the frame, a plurality of wheels with at least one of the wheels being driven by the engine, a boom having a first end pivotally attached to the frame about a boom pivot, a boom actuator being adapted to controllably move the boom about the pivot in response to receiving a boom control signal, and a controller in communication with the boom actuator;

determining if the operator is actuating the boom and reading the boom position;

determining the boom velocity;

comparing the boom velocity to a commanded velocity to obtain a velocity error; and decreasing the speed of the engine in response to the velocity error to increase the speed of the boom.

11. The method for controlling the boom of a work vehicle as set forth in claim 10, wherein the vehicle further includes a position sensor connected to the boom actuator.

12. The method for controlling the boom of a work vehicle as set forth in claim 11, wherein the boom velocity is determined by the controller based upon a current boom position and a previous boom position as sensed by the position sensor.

13. The method for controlling the boom of a work vehicle as set forth in claim 10, further including the step of de-rating the tractive effort of the wheels.

14. The method for controlling the boom of a work vehicle as set forth in claim 13, further including the step of using a predefined algorithm to de-rate the tractive effort of the wheels.

15. The method for controlling the boom of a work vehicle as set forth in claim 14, further including the step of feeding the boom position into the algorithm for calculating the derivative and smoothing the signal.

16. The method for controlling the boom of a work vehicle as set forth in claim 13, wherein the work vehicle further includes a torque converter.

17. The method for controlling the boom of a work vehicle as set forth in claim 16, further including the step of estimating the current tractive effort based upon engine speed and the torque converter's output speed.

18. The method for controlling the boom of a work vehicle as set forth in claim 10, further including the step of estimating the commanded velocity of the boom based upon the speed of the engine and a boom command generated by the operator actuating the boom.

19. A boom control system for a work vehicle having a boom and a component that drives the work vehicle, the boom control system comprising:

a boom actuator connected to the boom, the boom actuator being adapted to controllably move the boom about a pivot in response to receiving a boom control signal;

a sensor capable of sensing the boom; and a controller in communication with the boom actuator, the sensor, and the component that drives the work vehicle, the controller being adapted to determine if the operator is actuating the boom, to determine the boom velocity using the sensor, and to compare the boom velocity to a commanded velocity in order to obtain a velocity error, the controller decreasing power from the component in response to the velocity error to increase the speed of the boom.

20. The boom control system as set forth in claim 19, wherein the boom velocity is determined by the controller based upon a current boom position and a previous boom position as sensed by the sensor.

21. The boom control system as set forth in claim 19, wherein the component that drives the work vehicle comprises a plurality of wheels and the controller decreases power from the wheels to de-rate the tractive effort of the wheels in response to the velocity error.

22. The boom control system as set forth in claim 21, wherein the controller uses a predefined algorithm to de-rate the tractive effort of the wheels using the boom position.

23. The boom control system as set forth in claim 19, wherein the controller estimates the current tractive effort of the wheels based upon engine speed and a torque converter's output speed.

24. The boom control system as set forth in claim 19, wherein the controller estimates the commanded velocity of the boom based upon engine speed and a boom command generated by an operator activating the boom actuator.

25. The boom control system as set forth in claim 19, wherein the component that drives the work vehicle comprises an engine and the controller decreases power from the engine to reduce the speed of the engine in response to the velocity error.

* * * * *